United States Patent [19]

Adams et al.

[11] 3,982,470

[45] Sept. 28, 1976

[54] CONTROL SYSTEM FOR AXIAL PISTON FLUID ENERGY TRANSLATING DEVICE

[75] Inventors: Cecil E. Adams; Leo H. Dillon, both of Columbus, Ohio

[73] Assignee: Abex Corporation, New York, N.Y.

[22] Filed: Aug. 4, 1975

[21] Appl. No.: 601,554

[52] U.S. Cl. ..... 91/506; 91/434; 92/12.2

[51] Int. Cl.[2] ..... F15B 13/14; F01B 3/00; F01B 13/04

[58] Field of Search ..... 91/434, 504, 505, 506, 91/6.5; 92/12.2

[56] References Cited

UNITED STATES PATENTS 3,332,323 7/1967 Roeske ..... 92/12.2

*Primary Examiner*—William L. Freeh
*Assistant Examiner*—G. P. La Pointe
*Attorney, Agent, or Firm*—Thomas S. Baker, Jr.; David A. Greenlee

[57] ABSTRACT

A control for an axial piston type variable displacement fluid energy translating device has an auxiliary control device which connects to a manual control and provides a variety of operating functions for the fluid energy translating device.

17 Claims, 7 Drawing Figures

CONTROL SYSTEM FOR AXIAL PISTON FLUID ENERGY TRANSLATING DEVICE

BACKGROUND OF THE INVENTION

1. Field of the Invention

The instant invention relates generally to variable displacement axial piston type fluid energy translating devices and more specifically to the control devices therefore.

2. Description of the Prior Art

A common type of axial piston fluid energy translating device is a pump or motor which includes a housing having a rotatably mounted barrel with a plurality of circumferentially spaced cylinder bores. A port plate is interposed between the barrel and the inlet and working ports of the device to alternately connect each cylinder with the inlet and working ports of the device as the barrel is rotated. Within each bore is a piston which is connected by shoes to a thrust plate assembly mounted on a pivotal rocker cam assembly which reciprocates the pistons to pump fluid as the barrel is rotated.

In one form of variable displacement axial piston pump, the rocker cam assembly is pivoted about an axis perpendicular to the axis of rotation of the barrel to vary the inclination of the thrust plate assembly. This changes the stroke of the pistons and consequently changes the displacement of the pump. In such pumps, a control device is provided to vary the inclination of the rocker cam.

In the United States Letters Patent 3,803,987 to Knapp, and assigned to the assignee of the instant invention, a variable displacement axial piston pump is shown with a displacement control device which operates a pair of control pistons to pivot a rocker cam in a cam cradle. The control pistons receive pressure fluid through a servo valve which includes a valve spool and follower valve sleeve. A manually operated hydraulic actuator supplies pressure fluid to move the spool relative to the sleeve to supply fluid to one control piston or the other. The sleeve is connected through a mechanical feed-back linkage to the rocker cam. As the cam is moved the sleeve is displaced until it reaches a neutral position with the spool which cuts off fluid flow to the control pistons.

In United States Letters Patent 3,739,691 to Bobier, a variable displacement axial piston pump is shown with a rocker cam assembly mounted on a pivotable yoke. As the yoke pivots, the rocker cam assembly is pivoted with respect to the cylinder barrel to change the stroke of the pistons. An L-shaped arm on the yoke has a slot which engages a connecting pin. This pin is connected to a displacement control device. In one embodiment, the displacement control device is a piston mounted in a housing bore and positioned by a thumb screw.

Such prior art displacement control devices are connected to the rocker cam by a mechanical linkage. A disadvantage of such devices is the tolerances inherent in mechanical linkages which may cause free play and may make precise positioning of the rocker cam difficult.

Additionally, such prior art displacement control devices may lack functions such as automatically centering the pump, or by-passing working fluid and applying or releasing a brake for a vehicle operated by the pump. These and other functions are desirable in certain applications as described hereinafter.

SUMMARY OF THE INVENTION

The present invention departs from these and other prior art devices by providing a plurality of novel displacement control devices for positioning the rocker cam in an axial piston type device (generally referred to as a variable displacement fluid energy translating device). If a prime mover drives the device such that low pressure fluid is supplied and high pressure fluid is exhausted, the device is commonly referred to as a pump. If, however, high pressure fluid is supplied to operate the device and low pressure fluid is exhausted, it is referred to as a motor. This invention contemplates an auxiliary control device having a basic cover plate in which parts may be easily interchanged to provide a plurality of control functions for pumps and for motors.

According to the principles of the invention, the displacement control devices operate a fluid motor having a member which is rigidly secured to and movable with the rocker cam. Further, the control devices are incorporated in a cover plate which can be easily modified to accommodate devices having different control functions. This arrangement and structural details thereof are believed to produce a compact control having a precision of adjustment and reliability of operation previously unknown in the art.

DESCRIPTION OF THE PREFERRED EMBODIMENT

Figure 1:
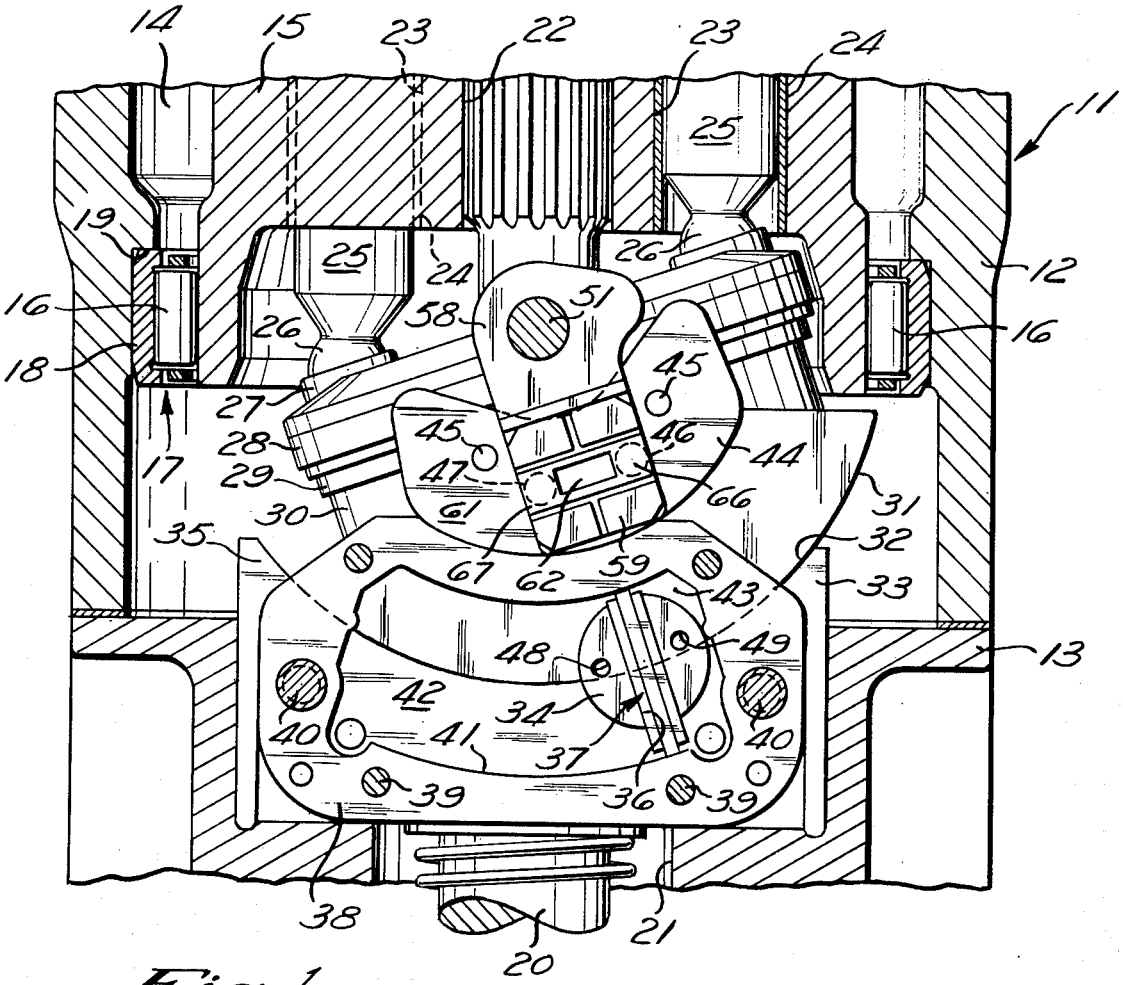
FIG. 1 is a part sectional view of a fluid energy translating device and a portion of a manual displacement control device therefore.

Referring now to FIG. 1, an axial piston pump has a case 11 which includes a central housing 12, an end cap 13 at one end and a port cap, not shown, at the other end. Case 11 may be fastened together by bolts or other known means.

Case 11 has a cavity 14 in which a rotatable cylinder barrel 15 is mounted on rollers 16 of a bearing 17 which has its outer race 18 pressed against a housing shoulder 19. A drive shaft 20 passes through a bore 21 in end cap 13 and is drivingly connected to a central bore 22 in barrel 15.

Barrel 15 has a plurality of bores 23 equally spaced circumferentially about the rotational axis of the barrel 15. A sleeve 24 in each bore 23 receives a piston 25. Each piston 25 has a ball-shaped head 26 which is received in a socket 27 of a shoe 28.

Each shoe 28 is retained against a flat creep or thrust plate 29 mounted on a movable rocker cam 30 by a shoe retainer assembly fully described in application Ser. No. 494,696, filed Aug. 2, 1974 and assigned to the assignee of the instant invention. This application describes a basic pump which can be operated by some of the displacement control devices of the instant invention.

Referring again to FIG. 1, rotation of drive shaft 20 by a prime mover, such as an electric motor, not shown, will rotate barrel 15. Rocker cam 30 pivots about an axis which intersects the axis of rotation of the barrel and which is perpendicular to the axis. If rocker cam 30 and thrust plate 29 are inclined from a neutral or centered (minimum fluid displacement) position normal to the axis of shaft 20, the pistons 25 will reciprocate as the shoes 28 slide over plate 29. As piston 25 moves downward toward rocker cam 30 as viewed in FIG. 1, low pressure fluid is received in the cylinder bores 23. As the pistons move upward toward a port plate, not shown, they expel high pressure fluid into an exhaust port. Fluid displacement increases as the inclination of thrust plate 29 increases.

The pump displacement changing mechanism will next be described. Rocker cam 30 has an arcuate bearing surface 31 which is received in a complementary surface 32 formed on a rocker cam support 33 mounted in end cap 13. Rocker cam 30 pivots about a fixed axis perpendicular to the axis of rotation of barrel 15. Rocker cam 30 which carries thrust plate 29 is moved relative to support 33 by a fluid motor.

A vane or motor member 34 is formed integrally with the sides of rocker cam 30 so as to be rigidly secured thereto and movable therewith. The vane 34 extends beyond bearing surface 32 to overlie the side 35 of rocker cam support 33 so that the center of vane 34 is at surface 32. The vane 34 has a central slot 36 which receives a seal assembly 37.

A vane housing 38 is located on support 33 by pins 39 and is attached to support 33 by bolts 40. One half of vane housing 38 overlies rocker cam 30 so that vane 34 is received in an arcuate chamber 41 in the housing 38. A cover, not shown, closes the end of vane housing 38 and is secured by bolts 40. As thus assembled, vane 34 and its seal assembly 37 divide chamber 41 into a pair of expansible fluid chambers 42, 43 to form a fluid motor.

The fluid motor is operated by supplying pressurized fluid to one of the chambers 42, 43 and exhausting fluid from the other chamber 42, 43 to move vane 34 within chamber 41. The operation of the fluid motor is controlled by a servo or follow-up control valve mechanism which regulates the supply of pressurized fluid to chambers 42, 43. The mechanism includes a fluid receiving valve plate 44 mounted on rocker cam 30 by bolts 45. The fluid receiving valve plate 44 and vane 34 move along concentric arcuate paths when rocker cam 30 is moved.

Valve plate 44 has a pair of ports 46, 47 which are connected to respective fluid chambers 42, 43 through a pair of drilled passageways 48, 49 which terminate in vane 34 on either side of seal assembly 37.

For counterclockwise operation of the fluid motor, as viewed in FIG. 1, pressure fluid is supplied to port 46 and flows through passageway 48 into chamber 42 to move vane 34 and rocker cam 30 counterclockwise. Expansion of chamber 42 causes chamber 43 to contract and exhaust fluid through passageway 49 out of port 47 and into the pump casing.

For clockwise operation of the fluid motor, the fluid flow is reversed. Pressure fluid is supplied to port 47, flows through passageway 49 and expands chamber 43 to move vane 34 and rocker cam 30 clockwise. Chamber 42 contracts and exhausts fluid through passageway 48 out of port 46 and into the pump casing.

Figure 2:
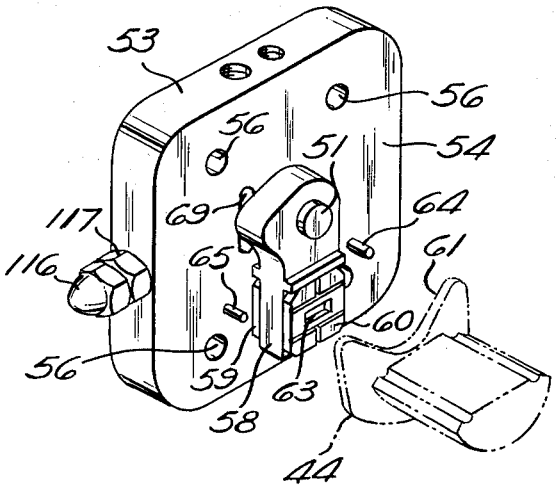
FIG. 2 is a perspective view showing the inner side of a cover plate which houses a displacement control device for the fluid energy translating device of FIG. 1.
Figure 3:
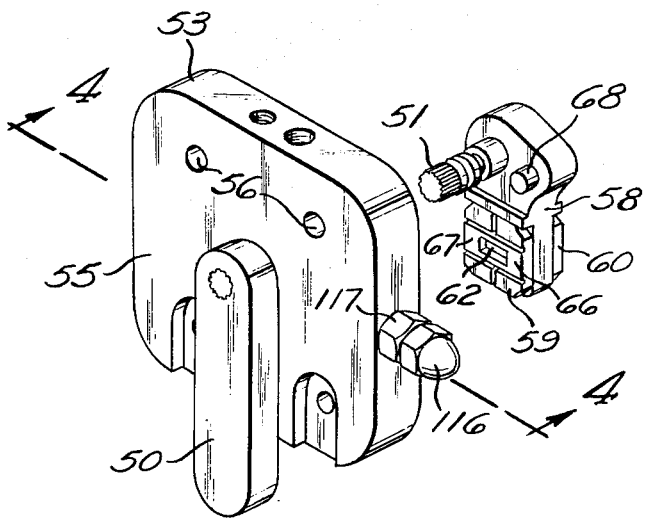
FIG. 3 is a perspective view showing the outside of the cover plate of FIG. 2.

Referring to FIGS. 1–3, that portion of the follow-up control valve mechanism which selectively supplies fluid to ports 46, 47 in valve plate 44 will now be described. A manual control handle 50 is attached to an input shaft 51 which is mounted in a bore 52 in a cover plate 53. FIG. 2 shows the flat inner surface 54 (i.e., the surface that overlies valve plate 44) of cover plate 53, while FIG. 3 shows the outside surface 55 of plate 53. Cover plate 53 is attached to housing 12 through holes 56 by bolts, not shown, and includes a fluid port 57, best seen in FIG. 4, which receives servo pressure fluid from a source, not shown. An arm 58 positioned on the inside of cover plate 53 is fastened to input shaft 51.

An input valve member includes a pair of identical valve shoes 59, 60 which are received in a bore, not shown, in arm 58. Shoe 59 rides on flat inner surface 54 of cover plate 53 and shoe 60 rides on a flat surface 61 of valve plate 44. Each shoe 59, 60 has a central bore, not shown, which opens into fluid ports 62, 63 respectively. Ports 62, 63 are connected and are continuously fed fluid from cover plate port 57. Stop pins 64, 65 on the inside of cover plate 53 set the maximum displacement of the pump and prevent arm 58 from moving port 62 in shoe 59 out of fluid communication with port 57.

Operation of the fluid motor by the servo control valve mechanism to change the displacement of the pump will now be described. When the fluid motor is at rest, fluid port 63 in shoe 60 lies between valve ports 46, 47 and the ports are covered by flats 66, 67 on the shoe. To change the displacement of the pump, control handle 50 is moved in the direction rocker cam 30 is to pivot. Thus, if handle 50 is moved clockwise as viewed in FIG. 3 this moves shoe 60 clockwise and aligns fluid port 63 (which is in fluid communication with fluid port 62 in shoe 59 and supply port 57 in cover plate 53 under all conditions) with port 47 while port 46 is uncovered. Pressure fluid flows from port 63 into port 47, through passageway 49, and into chamber 43. Simultaneously, fluid exhausts from chamber 42 through passageway 48 and out uncovered port 46. This pivots rocker cam 30 clockwise as described above. Rocker cam 30 is pivoted counterclockwise in a similar manner when control handle 50 is moved counterclockwise to align port 63 with valve plate port 46.

Accurate follow-up is provided since angular movement of rocker cam 30 and valve plate 44 is equal to that of control handle 50. When rocker cam 30 and valve plate 44 have moved through the same angle as control handle 50, port 63 is centered between ports 46, 47, while flats 66, 67, cover ports 46, 47 and the fluid motor stops.

A plurality of auxiliary control devices, which connect to arm 58 to provide pump control functions additional to those provided by the manual servo control valve mechanism will now be described. Each auxiliary control device is housed in a cover plate. The control devices shown in FIGS. 4—4B use the same cover plate but different parts whereas the control device shown in FIG. 5 requires a cover plate with additional bores and parts.

Figure 4:
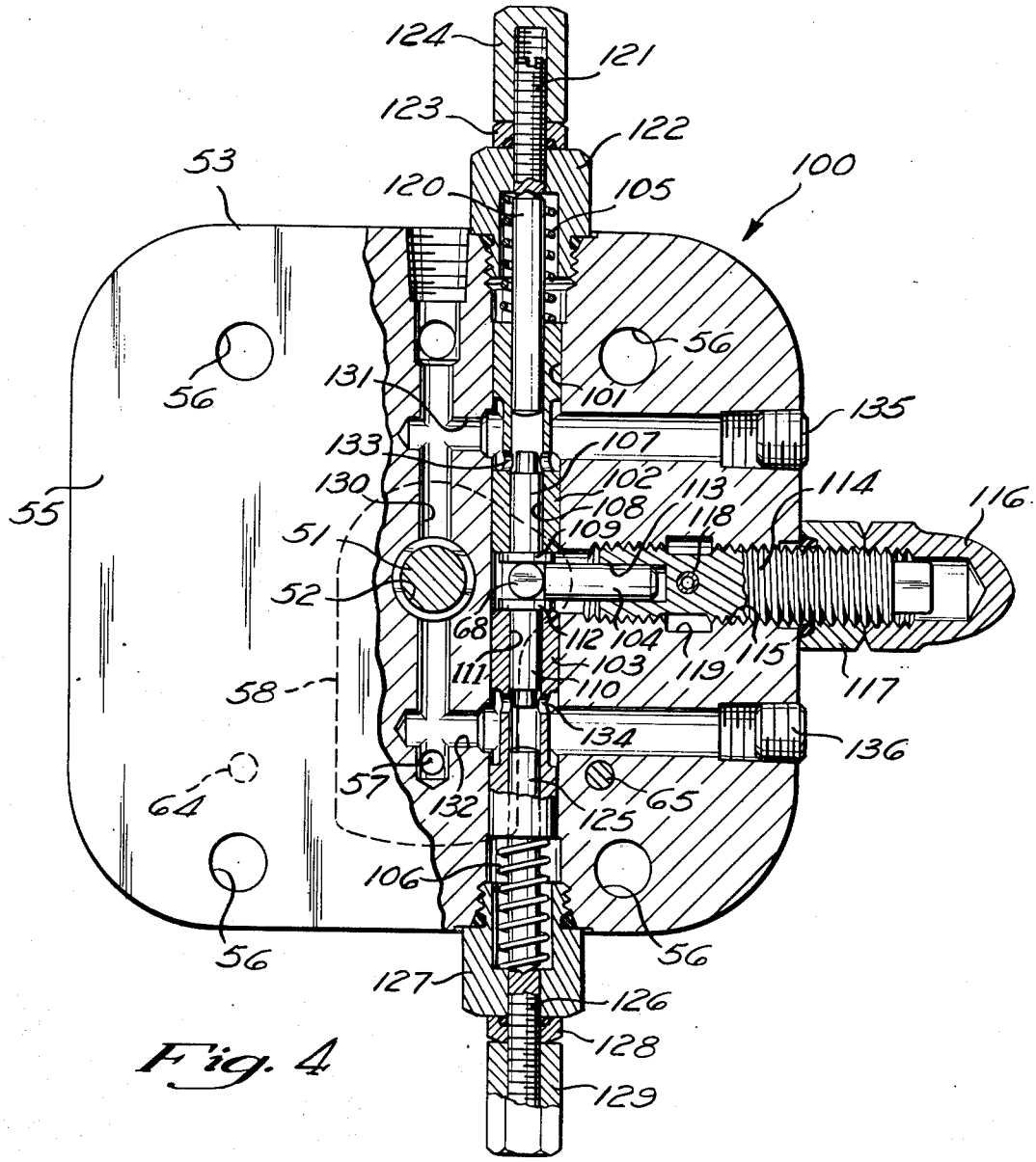
FIG. 4 is a part sectional view taken along line 4—4 of FIG. 3 showing a first embodiment of a control device.

FIG. 4 shows an auxiliary control device 100 for automatically centering or destroking the pump. An operating member in the form of pin 68 projects from arm 58 (see FIG. 3) upwardly through an elongated slot 69 in cover plate 53, (see FIG. 2) and into a bore 101 as shown in FIG. 4. A pair of opposed spools 102, 103 in bore 101 are biased to a centered position where they engage stop means or pin 104, by springs 105, 106 respectively. An insert 107 pressed into the inner end of a bore 108 in spool 102 has a head 109 which engages pin 68 when arm 58 is moved away from the centered position in one direction. An insert 110 pressed into the inner end of a bore 111 in spool 103 has a head 112 which engages pin 68 when arm 58 is moved away from the centered position in the other direction.

Pin 68 is the same diameter as stop pin 104 so that the position of pin 68 and arm 58 is accurately determined by the position of pin 104. Stop pin 104 is mounted in an eccentric bore 113 of a member 114 threaded in a bore 115. To adjust the minimum displacement or neutral position of rocker cam 30, a cap 116 is removed, a locknut 117 is loosened and member 114 is rotated to move stop pin 104 axially of bore 101. This moves one of spools 102, 103 and pin 68 is moved by the other spool to follow stop pin 104. Pin 68 will thereby move arm 58 until the fluid motor positions rocker cam 30 in the neutral position.

A pin 118 in threaded member 114 which extends into a slot 119 in a cover plate 53 prevents threaded member 114 from being rotated excessively inwardly or outwardly, but permits adequate movement of pin 104 for precise center trimming of pin 68 and rocker cam 30.

Pins 64, 65 set the maximum displacement of the pump as mentioned above. Additionally, the displacement of the pump in one direction can be set at less than maximum by a piston 129 slidably mounted in the other end of bore 108. Piston 120 engages an adjustable threaded stop member 121 at its outer end and insert 107 at its inner end to limit the travel of spool 102 and pin 68 away from the center position. Stop member 121 is threaded into a plug 122 to permit adjustment of the desired pump displacement in one direction and is secured by a locknut 123. An end cover 124 is threaded onto member 121.

The displacement of the pump in the other direction is set at less than maximum by a similar adjustment arrangement including a piston 125 slidably mounted in the outer end of bore 111. Similarly, piston 125 engages an adjustable threaded stop member 126 at its outer end and insert 110 at its inner end to limit the travel of spool 103 and pin 68 away from the center position. This adjustment arrangement includes a plug 127, a locknut 128 and an end cover 129.

As thus described, the spring-biased spools 102, 103 in the automatic pump centering auxiliary control device 100 bias control arm pin 68 to a centered position set by the adjustment of stop pin 104 in which rocker cam 30 is in a minimum displacement position. Further, the displacement of the pump in either direction is set by one of the threaded stop members 121, 126.

A stepped bore 130 is provided in cover plate 130 to supply servo pressure fluid from a source not shown to port 57 and a pair of stepped bores 131 and 132 which are closed at one end by plugs 135, 136 respectively. Bore 131 feeds servo fluid to bore 108 through an opening 133 in spool 102 and bore 132 feeds servo fluid to bore 111 through an opening 134 in spool 103. Fluid in bore 108 reacts against piston 120 to bias insert 107 and spool 102 against pins 68, 104 while fluid in bore 111 reacts against piston 125 to bias insert 112 and spool 103 against pins 68, 104. It should be noted that in the instant pump the pressure of the servo fluid is directly proportional to the pressure of the working fluid as fully described in copending application Ser. No. 515,270 filed Oct. 16, 1974 and entitled "Control System for a Variable Displacement Pump." Consequently, as the working pressure increases, the fluid force tending to center pin 68 increases. This allows an operator to "feel" an increase in working pressure through the increased resistance as control handle 50 is moved, or held off center.

Figure 4A:
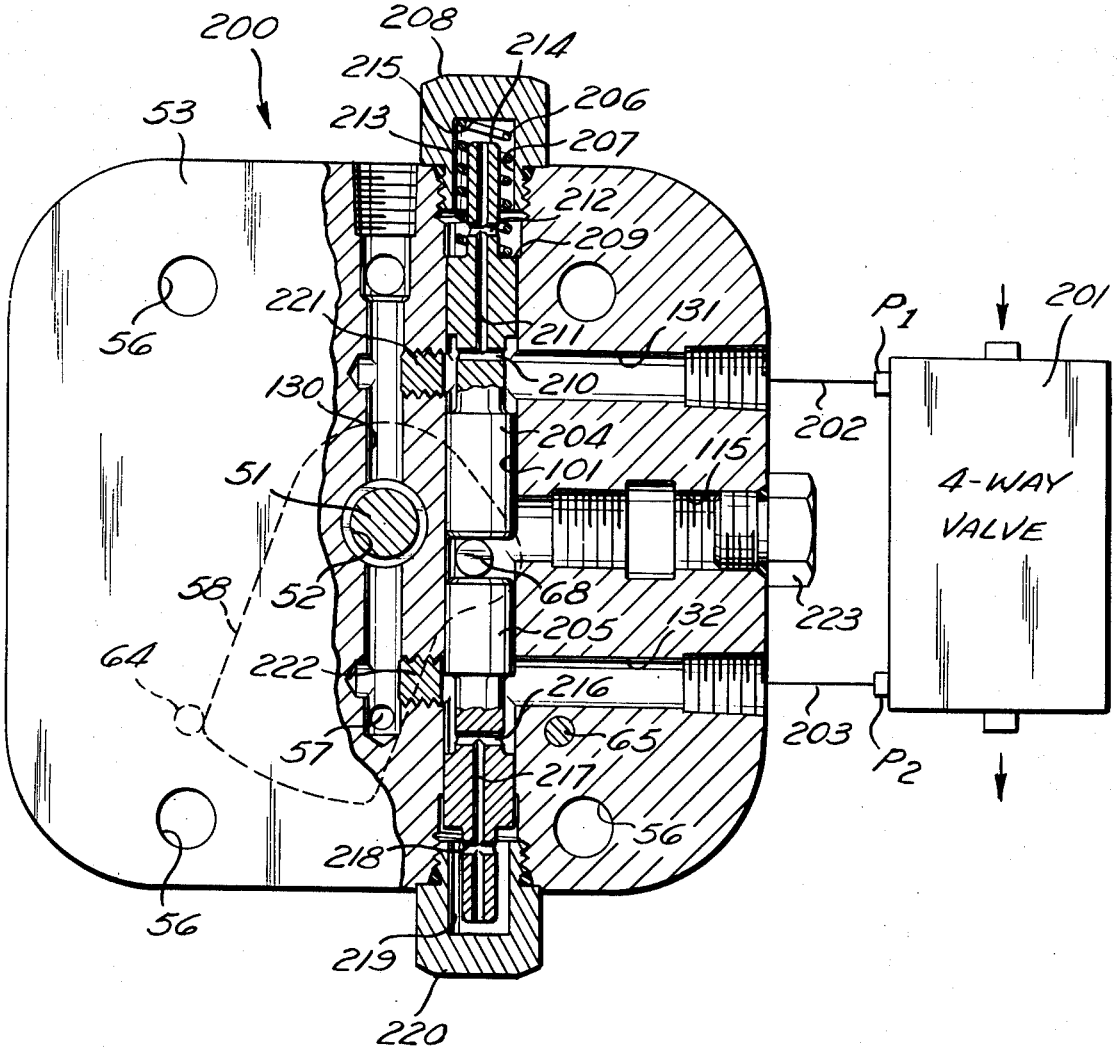
FIG. 4A is a view similar to FIG. 4 showing a second embodiment of a control device.

FIG. 4A shows an auxiliary control device 200 for controlling a fluid motor rather than a pump. The device 200 is connected to the work ports $P_1$, $P_2$ of a standard type four-way valve 201 which operates to shift pin 68 and arm 58 between positions of maximum and reduced displacement of the motor.

Valve 201 is connected to bores 131, 132 in cover plate 53 by lines 202, 203 respectively. A pair of opposed spools 204, 205 are located in bore 101 on either side of pin 68. A spring 206, housed in a cavity 207 of a plug 208, engages a shoulder 209 to bias spool 204, pin 68 and spool 205 downward, as viewed in FIG. 4A. This pivots arm 58 clockwise against stop pin 64 to operate the fluid motor to its maximum displacement, slowest speed position when four-way valve 201 is not supplying fluid to device 200. This is a safety feature which prevents the motor from overspeeding if it is started before valve 201 is operated.

Arm 58 is hydraulically moved clockwise to the maximum displacement, slowest motor speed position when valve 201 supplies pressure fluid to lien 202, bore 131 and bores 210, 211, 212 in spool 204. The fluid fills cavity 213, defined by the end of spool 204 and plug 208, and moves spool 204 downward to pivot pin 68 and arm 58 clockwise until arm 58 engages stop pin 64.

Arm 58 is hydraulically moved counterclockwise to a reduced displacement, increased motor speed position when valve 201 supplies pressure fluid to line 203, bore 132 and bores 216, 217, 218 in spool 205. The fluid fills a cavity 219, defined by the end of spool 205 and a plug 220, and moves spool 205, pin 68 and spool 204 upwardly in opposition to spring 206. The reduced displacement, increased motor speed position is reached when outer end 214 of spool 204 engages inner surface 215 of plug 208 and arm 58 cannot pivot further counterclockwise. Normally the length of spool 204 is selected such that arm 58 is stopped at a position where motor displacement is approximately one third of maximum. This prevents the fluid motor from overspeeding, since the speed of the motor increases as its displacement decreases when volume remains constant.

Pressure fluid from four-way valve 201 is prevented from mixing with the servo fluid in stepped bore 130 by a pair of plugs 221, 222 in bores 131, 132, respectively. A plug 223 prevents fluid leakage from bore 115 since there is no center adjustment in this embodiment of the device.

Figure 4B:
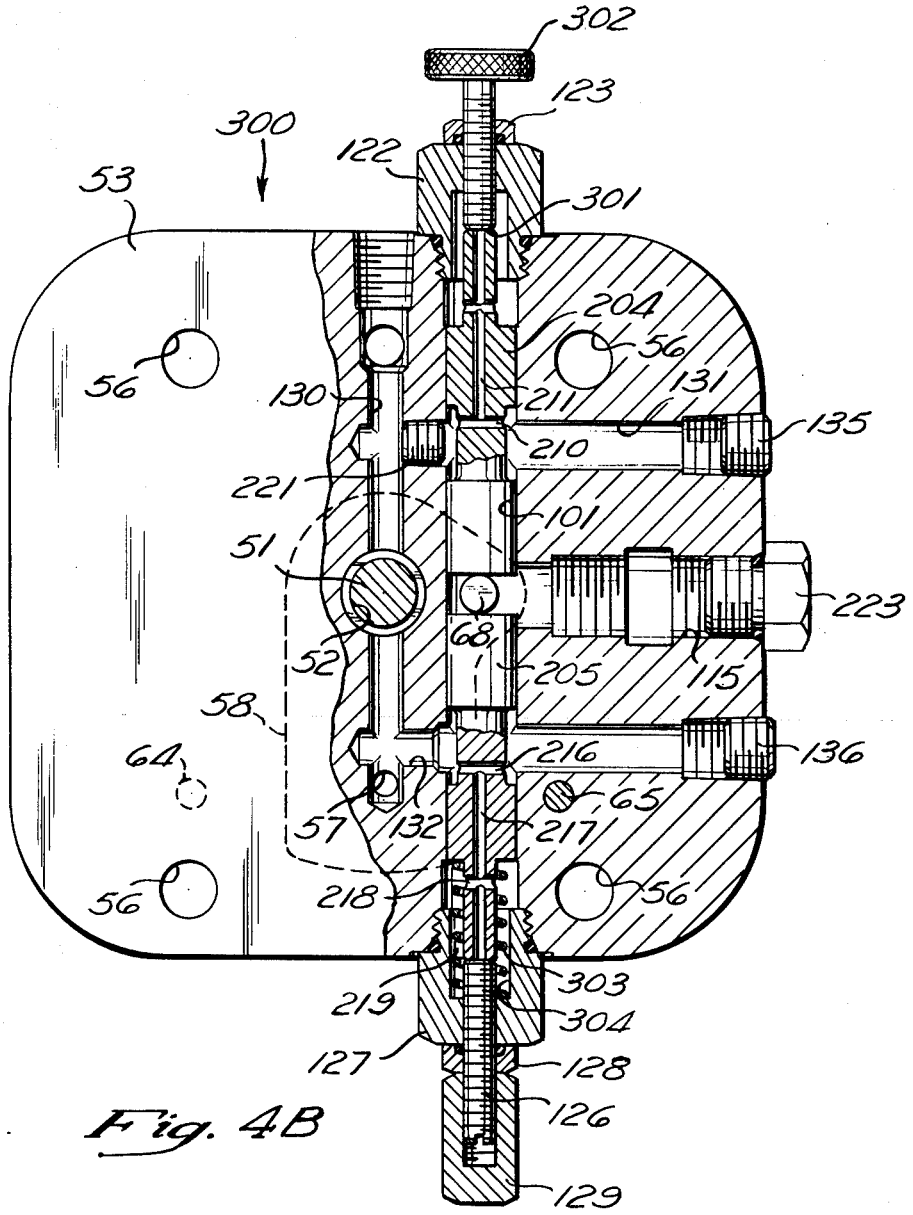
FIG. 4B is a view similar to FIG. 4 showing a third embodiment of a control device.

FIG. 4B shows an auxiliary control device 300 having a manual thumb wheel or hand wheel control for setting the displacement of a pump.

Cover plate 53 houses opposed spools 204, 205 in bore 101 on either side of pin 68. Spool 204 is biased into engagement with the end 301 of a threaded thumb or hand wheel 302 by pin 68, spool 205 and a spring 303, confined between spool 205 and the bottom of a cavity 304 in threaded plug 127. Hand wheel 302 is threaded into plug 122 and secured by locknut 123. To change the displacement of the pump, hand wheel 302 is rotated to move spools 204, 205 and pin 68 and to pivot arm 58 until the desired displacement is reached.

Servo pressure fluid supplied via bores 130, 132, and bores 216, 217, 218 in spool 205 to a cavity 219 biases spool 205 and pin 68 upwardly to force spool 204 against hand wheel 302.

For maximum pump displacement hand wheel 302 is moved outwardly until spring 303 and servo pressure fluid move pin 68 upwardly enough to force arm 58 against stop pin 65. For minimum pump displacement, hand wheel 302 is moved inwardly to force spool 204 and pin 68 to move spool 205 downwardly into engagement with adjustable stop member 126. Member 126 is threaded into plug 127 and secured in position by a locknut 128. Stop member 126 is a minimum volume stop which is set to prevent the pump from going past a position of zero displacement.

Plug 221 is provided in bore 131 to prevent servo fluid in bore 130 from flowing into the chamber above spool 204 to oppose the upward biasing force of spring 303 and the servo fluid in cavity 219. Plugs 135, 136 close bores 131, 132 and plug 223 blocks bore 115 since there is no stop pin and center adjustment in this embodiment.

Figure 5:
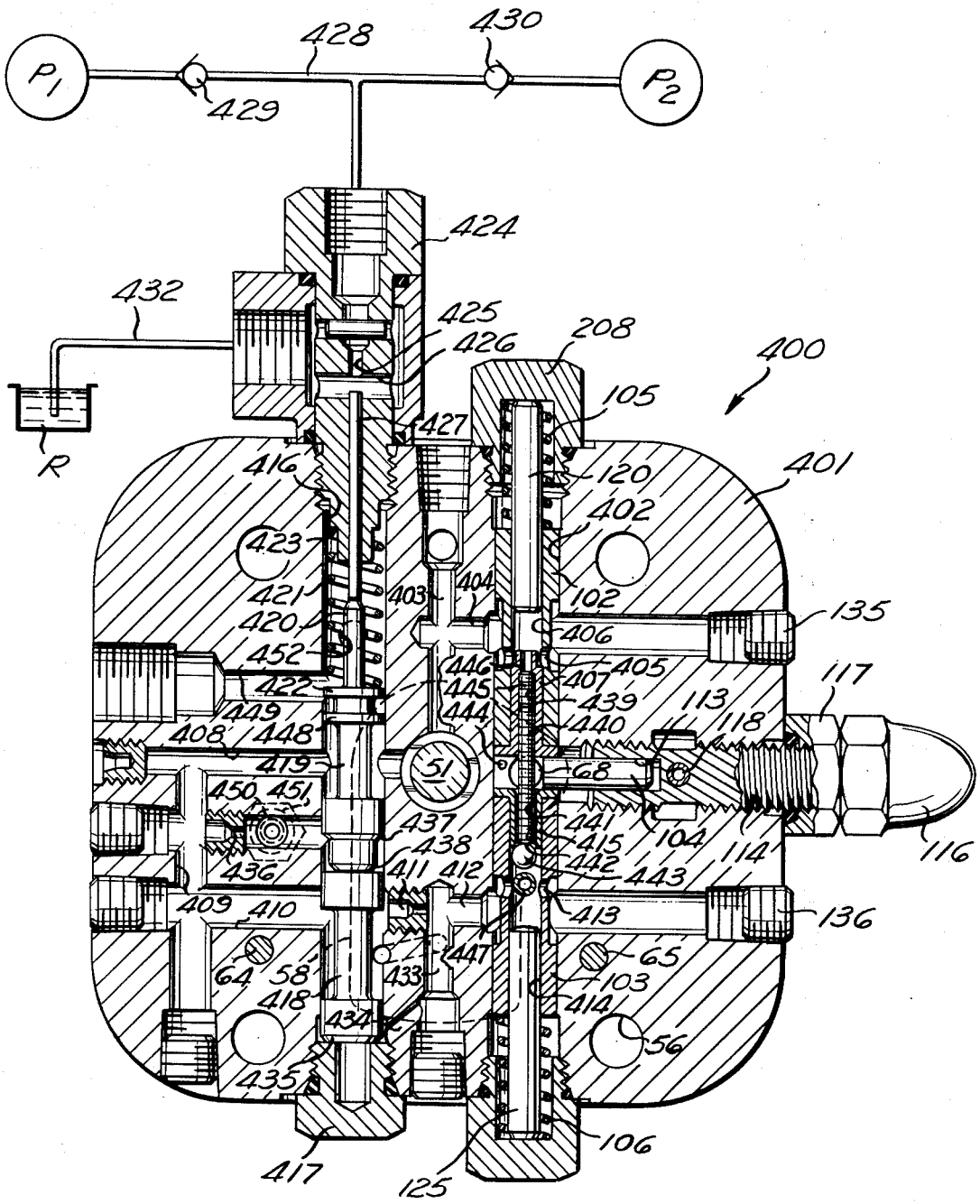
FIG. 5 is a view similar to FIG. 4 showing a fourth embodiment of a control device.

FIG. 5 shows an auxiliary control device 400 for a pump which automatically destrokes the pump when manual control handle 50 is released and which bypasses residual fluid from the working port of the pump to tank and interrupts the supply of servo pressure fluid to a spring-applied pressure-released brake used on a vehicle, not shown, operated by the pump, whenever both thrust plate 29 and arm 58 are in the neutral or center position.

In control device 400 a cover plate 401 has a through bore 402 which houses the mechanism for centering the pump. A pair of opposed spools 102, 103 in bore 402 are biased towards stop pin 104 by springs 105, 106 as in the embodiment of FIG. 4. Servo pressure fluid which is supplied to a stepped bore 403 from a source, not shown, flows through a stepped bore 404 to passages 405, 406 in spool 102 to react against piston 120 and insert 407 pressed into bore 406 to bias insert 407 and spool 102 towards stop pin 104. Servo pressure fluid also flows through bores 403, 408, 409, 410, an orifice 411, a stepped bore 412 and passages 413, 414 in spool 103 to react against a piston 125 in bore 414 and an insert 415 pressed into bore 414 to bias insert 415 and spool 103 towards stop pin 104.

Insert 407 has a threaded bore 439 which receives a screw 440 which projects downwardly into an enlarged bore 441 in insert 415. A socket 442 on the end of screw 440 permits its adjustment such that the socketed end projects just beyond the end of insert 415 to unseat a ball 443 and unblock bore 441 when arm 58 is in the center position. When either spool 102, 103 is moved away from center, ball 443 blocks bore 441 to permit normal operation of the centering mechanism. A second screw 445 with a socket 446 locks screw 440 in position and a pin 447 retains ball 443 in spool 103. The purpose of having ball 443 blocking and unblocking bore 441 will be explained hereinafter.

Cover plate 401 has a second through bore 416 which is closed at one end by a plug 417 and has a fitting 424 threaded onto the other end. Pump ports $P_1$, $P_2$ are connected to a stepped bore 425 in fitting 424 through line 428 and check valves 429, 430. Stepped bore 425 connects to reservoir R through lateral bore 426 and line 432.

Control device 400 by-passes residual fluid from the working one of the ports $P_1$, $P_2$ to reservoir R when thrust plate 29 is in the centered position and the pump is not displacing fluid. Likewise the supply of servo pressure fluid to an auxiliary passage 449 which may be connected to a spring-applied pressure-released brake is interrupted when thrust plate 29 is in the centered position. It should be noted that when thrust plate 29 is perfectly centered there will be no residual flow. However, vibrations in the pump or the prime mover prevent perfect centering of the thrust plate 29 at all times when arm 58 is centered.

When thrust plate 29 is out of the centered position servo pressure fluid from bore 409 flows through an orifice 436 and acts against tapered surfaces 437, 438 on a spool 419 in bore 416. The servo pressure fluid biases spool 419 and cylindrical pin 427 in the bore 425 which is engaged by a projection 420 on the spool upward until pin 427 blocks bore 425 upstream of lateral bore 426. This prevents the flow of residual fluid to reservoir R. When spool 419 is in the upward position a spool land 448 is beyond auxiliary passage 449 and servo pressure fluid is supplied to the passage.

When thrust plate 29 is stationary and in the centered position a fluid passage 450 in cover plate 401 is aligned with a passage 451 in valve plate 44 which connects to the inside of housing 12. This vents the servo pressure fluid downstream of orifice 436 and prevents the fluid from biasing spool 419 upward. If spool 419 is not biased upward by servo pressure fluid it is moved downward by a spring 421 acting between a shoulder 423 on fitting 424 and a shoulder 422 on spool 419. When spool 419 is moved to the downward position shown in FIG. 5, residual fluid from ports $P_1$, $P_2$ can push pin 427 downward and open bore 425. Also, spool land 448 blocks the flow of servo pressure fluid to auxiliary passage 449 and connects passage 449 to a drain hole 452 which causes fluid pressure in the passage to drop.

From the foregoing it can be seen that whenever thrust plate 29 is centered servo pressure fluid to spool 419 is vented and spring 421 can move spool 419 downward. However, there is one instance where it is undesirable to have spring 421 move spool 419 downward and vent ports $P_1$, $P_2$ and auxiliary passage 449 even though thrust plate 29 is centered. This is when arm 58 is moved across center to operate the displacement mechanism and thrust plate 29 moves across center and switches inlet and working ports of the pump. In so moving, plate 29 is only momentarily in the centered position and a shock would be imporated to the system if ports $P_1$, $P_2$ and passage 449 were momentarily vented.

In the instant displacement control shown in FIG. 1–3, thrust plate 29 crosses center only when control arm 58 is moved from one side of center to the other. It cannot cross center when arm 58 is centered. A second mechanism, which prevents downward movement of spool 419 when thrust plate 29 is moving, includes a spool 418 in bore 416 which senses the position of control arm 58. If arm 58 is out of the centered position servo pressure fluid in bore 412 flows through bores 433, 434 and acts on a tapered surface 435 to tend to bias spool 418 upwardly. The force is counterbalanced by servo pressure fluid on top of spool 418.

If thrust plate 29 is momentarily centered and arm 58 is not centered there is no servo pressure fluid on top of spool 418 and the fluid acting on tapered surface 435 will move spools 418, 419 upward in opposition to spring 421 and pin 427 will move upward to block bore 425 upstream of lateral bore 426.

As previously mentioned, when arm 58 is in the centered position ball 443 is unseated from insert 415 and bore 441 is unblocked. Therefore, servo pressure fluid downstream of orifice 411 flows through bore 441 and is vented into the pump housing so there is no pressure fluid tending to bias spool 418 upward.

Thus, it can be seen that residual working fluid from a pump port $P_1$, $P_2$ is by-passed to reservoir R and servo pressure fluid flow to an auxiliary passage is interrupted only when thrust plate 29 and arm 58 are both centered.

It can be seen that in the instant invention the cover plate can be easily modified by additional bores or parts to provide a plurality of different control functions. Further, the location of the auxiliary controls wholly within a removal cover plate on the pump housing permits the controls for a pump to be easily and quickly changed. Also, the instant displacement control device is not connected to the rocker cam by a mechanical linkage.

Obviously, those skilled in the art may make various changes in the details and arrangements of parts without departing from the spirit and scope of the invention as it is defined by the claims hereto appended. Applicant, therefore, wishes not to be restricted to the precise construction herein disclosed. Having thus described and shown in the embodiment of the invention, what is desired to secure by Letters Patent of the United States is:

We claim:

1. A control for an axial piston type variable displacement fluid energy translating device having a housing, a cover plate closing an opening in the housing, a pair of fluid ports, a pivotably mounted thrust plate for changing the displacement of the device, a servo fluid motor for pivoting the thrust plate between a position of maximum fluid displacement in one direction and a position of maximum displacement in the other direction with a centered position of minimum fluid displacement therebetween, means for supplying servo pressure fluid to operate said fluid motor including a control valve for selectively operating the servo fluid motor to move the thrust plate to the position set by the control valve, and the improvement comprising: an auxiliary control device, an operating member operatively connecting the auxiliary control device with the control valve, the auxiliary control device including stop means for setting an operating member position in which the control valve is in the thrust plate centered position, and means biasing the operating member into the position set by the stop member to cause the control valve to operate the servo fluid motor to move the thrust plate to the centered position.

2. The control recited in claim 1, wherein the auxiliary control device includes means for adjusting the position of the stop means.

3. The control recited in claim 2, wherein the adjustment means include a rotatable member and the stop means is mounted eccentrically on the rotatable member.

4. The control recited in claim 1, wherein the stop means is a first cylindrical pin, the operating member is a second cylindrical pin of the same diameter and movable into and out of alignment therewith, and the biasing means include a pair of pistons, and spring and pressure fluid means biasing the pistons into engagement with opposite sides of the first and second pins in the centered position.

5. The control recited in claim 4, wherein the auxiliary control device includes means for setting the maximum allowable fluid displacement position of the thrust plate in the one direction including a second stop member which limits the travel of one of the pair of pistons away from the first cylindrical pin.

6. The control recited in claim 1, including a fluid passage connecting the fluid ports to low pressure and the auxiliary control device including means blocking the passage when either the control valve or the thrust plate is not in the centered position.

7. The control recited in claim 6, wherein the auxiliary control device includes a first pressure responsive member which is fluid pressure biased in the one direction when the thrust plate is not in the centered position, a second pressure responsive member which is fluid pressure biased in the one direction when the control valve is not in the thrust plate centered position and the first pressure responsive member moves the blocking means to block the passage means whenever the first or second pressure responsive member is biased in the one direction.

8. The control recited in claim 7, wherein the auxiliary control device includes second means for biasing the first and second pressure responsive members in another direction, whereby the passage means is unblocked whenever the thrust plate is in the centered position and simultaneously the control valve is in the thrust plate centered position.

9. The control recited in claim 7, wherein the auxiliary control device includes second passage means for supplying servo pressure fluid to an auxiliary passage, the first pressure responsive member is movable to alternatively block or unblock the second passage means and the first pressure responsive member unblocks the second passage means when it is biased in the one direction.

10. The control recited in claim 1, wherein the auxiliary control device is located wholly within the cover plate.

11. The control recited in claim 1, including means for changing the pressure of the servo fluid in direct proportion to a change of the working pressure of the fluid energy translating device and the biasing means includes pressure responsive means which are operated by the servo fluid whereby the force of the biasing means increases as the load on the fluid energy translating device increases to provide feel.

12. A control for an axial piston type variable displacement fluid energy translating device having a housing, a cover plate closing an opening in the housing, a pair of fluid ports, a pivotably mounted thrust plate for changing the displacement of the device, a servo fluid motor for pivoting the thrust plate between a position of maximum fluid displacement in one direction and a position of maximum fluid displacement in the other direction with a centered position of minimum fluid displacement therebetween, means for supplying servo pressure fluid to operate said fluid motor including a control valve for selectively operating the servo fluid motor to move the thrust plate to the position set by the control valve, the improvement comprising an auxiliary control device, an operating member connecting the auxiliary control device with the control valve, the auxiliary control device including stop means for setting a fluid displacement position, and means biasing the operating member to the position set by the stop means to cause the control valve to operate the servo fluid motor to move the thrust plate to the set position, wherein the biasing means includes pressure fluid means and a pair of pistons received in a common bore one on each side of the operating member.

13. The control for an axial piston type variable displacement fluid energy translating device recited in claim 12, wherein the stop means includes a first stop member which projects into the bore and the first stop members sets a minimum fluid displacement position.

14. The control for an axial piston type variable displacement fluid energy translating device recited in claim 13, wherein the stop means includes a second stop element which projects into the bore, the second stop element sets a maximum fluid displacement position and the second stop element is adjustable along an axis parallel to that of the bore.

15. The control for an axial piston type variable displacement fluid energy translating device recited in claim 12, wherein the stop means includes a third stop element which is positioned outside of the bore and the third stop element sets a maximum fluid displacement position.

16. A control for an axial piston type variable displacement fluid energy translating device having a housing, a cover plate closing an opening in the housing, a pair of fluid ports, a pivotably mounted thrust plate for changing the displacement of the device, a servo fluid motor for pivoting the thrust between a position of maximum fluid displacement in one direction and a position of maximum fluid displacement in the other direction with a centered position of minimum fluid displacement therebetween, means for supplying servo pressure fluid to operate said fluid motor including a control valve for selectively operating the servo fluid motor to move the thrust plate to the position set by the control valve, the improvement comprising an operating member on the control valve projecting through a slot into the cover plate and an auxiliary control device located within the cover plate for positioning the operating member to control operation of the control valve.

17. The control recited in claim 16, wherein the auxiliary control device includes stop means for setting an operating member position in which the control valve is in the thrust plate centered position, and means biasing the operating member into the position set by the stop member to cause the control valve to operate the servo fluid motor to move the thrust plate to the centered position.

* * * * *

UNITED STATES PATENT OFFICE

CERTIFICATE OF CORRECTION

Patent No. 3,982,470 Dated September 28, 1976

Inventor(s) Cecil E. Adams et al.

It is certified that error appears in the above-identified patent and that said Letters Patent are hereby corrected as shown below:

Column 4, line 36, after "valve" should read --- plate ---.

Column 5, line 38, "129" should read --- 120 ---.

Column 12, line 9, after "thrust" should read --- plate ---.

Signed and Sealed this

Eighteenth Day of January 1977

[SEAL]

*Attest:*

RUTH C. MASON
*Attesting Officer*

C. MARSHALL DANN
*Commissioner of Patents and Trademarks*